United States Patent [19]

Matsui et al.

[11] 4,419,789

[45] Dec. 13, 1983

[54] TORSION HINGE

[75] Inventors: Tatsuhiko Matsui, Tokyo; Yasumasa Okada, Hino; Minoru Shimatsu, Koganei, all of Japan

[73] Assignee: Nissan Motor Co., Ltd., Yokohama, Japan

[21] Appl. No.: 194,529

[22] Filed: Oct. 6, 1980

[30] Foreign Application Priority Data

Oct. 9, 1979 [JP] Japan ..... 54-140870[U]

[51] Int. Cl.[3] ..... E05F 1/12

[52] U.S. Cl. ..... 16/308; 16/75

[58] Field of Search ..... 16/128.1, 308, 75; 49/386; 267/154

[56] References Cited

U.S. PATENT DOCUMENTS

| | | | |
|---|---|---|---|
| 2,916,763 | 12/1959 | Wagner | 16/308 |
| 4,291,501 | 9/1981 | Steinberg et al. | 16/308 X |

FOREIGN PATENT DOCUMENTS

| | | |
|---|---|---|
| 1149268 | 5/1963 | Fed. Rep. of Germany . |
| 1191699 | 4/1965 | Fed. Rep. of Germany . |
| 7018980 | 9/1970 | Fed. Rep. of Germany . |
| 7507648 | 7/1975 | Fed. Rep. of Germany . |
| 2418137 | 9/1979 | France . |
| 755312 | 8/1956 | United Kingdom . |
| 847306 | 9/1960 | United Kingdom . |
| 1086385 | 10/1967 | United Kingdom . |
| 2015641 | 9/1979 | United Kingdom . |
| 803554 | 10/1979 | United Kingdom . |

*Primary Examiner*—Werner H. Schroeder
*Assistant Examiner*—Andrew M. Falik
*Attorney, Agent, or Firm*—Thompson, Birch, Gauthier & Samuels

[57] ABSTRACT

A vehicle trunk lid opening mechanism including a lid pivotally mounted to the trunk, and two torsion bars which are arranged to produce, when the lid is closed, a torsional force to urge the lid to open. One end of each torsion bar is connected to the lid hinge and the other end of each bar is retained in a mounting hole formed in a panel of a body pillar located in the trunk.

6 Claims, 4 Drawing Figures

TORSION HINGE

BACKGROUND OF THE INVENTION

1. Field of the Invention

The present invention relates in general to an opening mechanism for use with an automobile, and more particularly to a torsion bar type opening mechanism for a swingably openable trunk lid of the vehicle.

2. Description of the Prior Art

As an opening mechanism for an automotive trunk lid or its equivalent, a torsion bar type opening mechanism has been widely used. Usually, such a mechanism comprises two reversely arranged torsion bars, each having one end connected to a stationary portion of the vehicle body and the other end connected to the lid. Upon closing the lid, each torsion bar is twisted about its axis to produce a torsional force urging the lid to open. In such conventional opening mechanisms, however, drawbacks have been encountered emanating from the complicated construction thereof. In fact, several brackets are usually required for connection between each torsion bar and its associated member or portion, thereby causing complications in construction. Sometimes, the presence of such brackets reduces the amount of usable trunk space and spoils the appearance of the assembled hinge mechanism. Further, the provision of such brackets increases the cost of vehicle manufacturing.

SUMMARY OF THE INVENTION

According to the present invention, there is provided an opening mechanism of an automobile trunk lid. The mechanism generally comprises a hinge-like pivot arm which swingably connects the lid to the trunk, and a torsion bar which produces, upon closing the lid, a torsional force to urge the lid to open. One end of the torsion bar is connected to the hinge and the other end is retained by a mounting hole formed in one of the rear pillars of the automobile.

It is an object of the present invention to provide an opening mechanism for a swingably openable automobile trunk lid, which is characterized by its simplicity in construction.

BRIEF DESCRIPTION OF THE DRAWINGS

Other objects and advantages of the present invention will become clear from the following description when taken in conjunction with the accompanying drawings, in which.

DETAILED DESCRIPTION OF THE INVENTION

Figure 1:
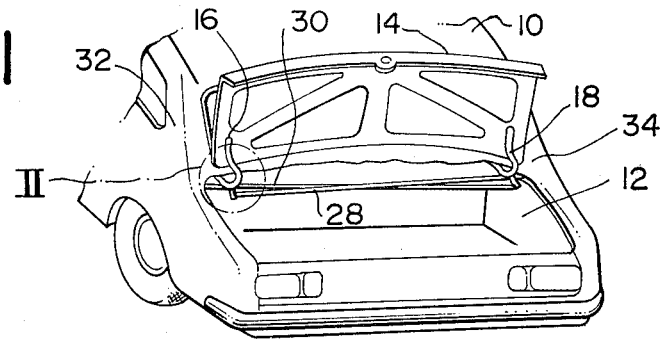
FIG. 1 is a perspective view of an automotive trunk and an open lid showing the improved opening mechanism of the present invention.

Referring to FIG. 1, there is partially shown an automobile 10 having a rear trunk 12. A lid or cover 14 is swingably connected to the trunk by means of two hinges. Similar to the conventional opening mechanisms mentioned hereinbefore, the mechanism of the present invention is constructed and arranged to produce, upon closing the lid 14, a force which urges the lid 14 to open.

The opening mechanism of the present invention includes two spaced identical hinges (or pivot arms) 16 and 18 which pivotally connect the lid 14 to the trunk 12. As will be understood from FIG. 2, each hinge 16 (or 18) is constructed to have a straight section **16*a* and a curved section 16*b* for the purpose of assuring smooth swinging movement of the lid 14. The straight section 16*a* of the hinge 16 is secured to the lid 14, while the leading end of the curved section 16*b* of same is pivotally connected by a pivot pin 20 to a stationary support 22 secured to the vehicle body. Although not shown in FIG. 2, the arrangement of the other hinge 18 with respect to the trunk 12 and the lid 14 is substantially the same as in the case of the hinge 16. An arm member 24 is secured at one of its ends to the curved section 16*b* of the hinge 16. The other end of the arm member 24 is formed with a longitudinally extending slot 26 for a purpose which will become clear as the description proceeds. The hinge 18 also has an arm corresponding to the member 24**.

Figure 2:
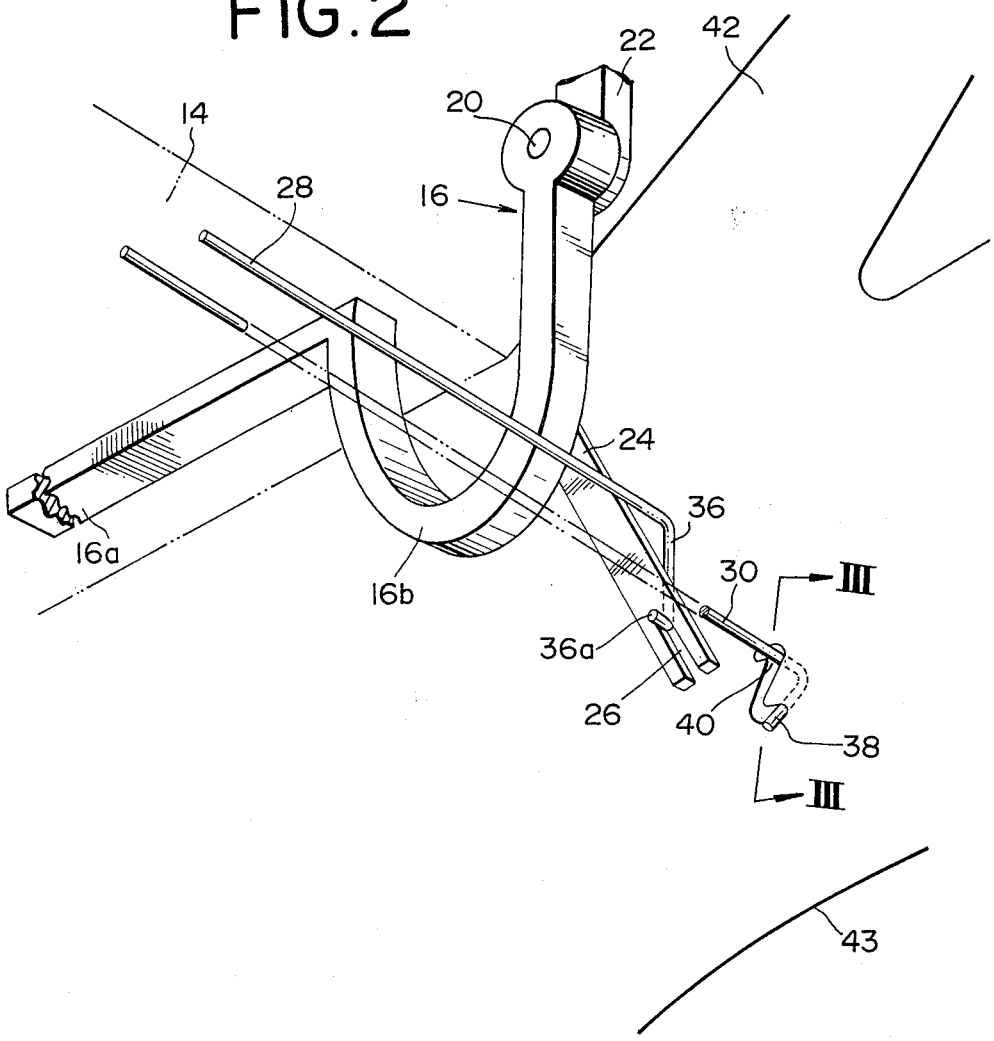
FIG. 2 is an enlarged detailed perspective view of the portion enclosed by a circle "II" indicated in FIG. 1.

The hinge mechanism further comprises two reversely arranged identical torsion bars 28 and 30 which lie across the trunk 12. More particularly, the torsion bars extend between two spaced rear pillars 32 and 34 of the vehicle body, as shown in FIG. 1. Each torsion bar 28 or 30 has one end 36 (only one is shown) bent into a L-shape and the other end 38 (only one is shown) bent into a V-shape. As shown in FIG. 2, the L-shaped end 36 of the torsion bar 28 engages the arm member 24 with the normally bent tip **36*a* thereof received in the slot 26, while the V-shaped end 38 of the other torsion bar 30 engages with an S-shaped mounting hole 40 formed in an inner panel 42 of the rear pillar 32 or its equivalent of the vehicle, adjacent a rear wheel housing 43. The manner in which the V-shaped end 38 engages the mounting hole 40** will be described in detail hereinafter.

It should be noted that the other end (not shown in FIG. 2) of the torsion bar 28 has the same construction as the V-shaped end 38 of the torsion bar 30, and the other end (not shown in FIG. 2) of the torsion bar 30 has the same construction as the L-shaped end 36 of the torsion bar 28. It is further to be noted that, although not shown in the drawings, the V-shaped end of the torsion bar 28 engages another S-shaped mounting hole of the other rear pillar 34 in substantially the same manner as in the case of the V-shaped end 38, and the L-shaped end of the torsion bar 30 engages the corresponding arm member of the hinge 18 in substantially the same manner as in the case of the L-shaped end 36.

Figure 3:
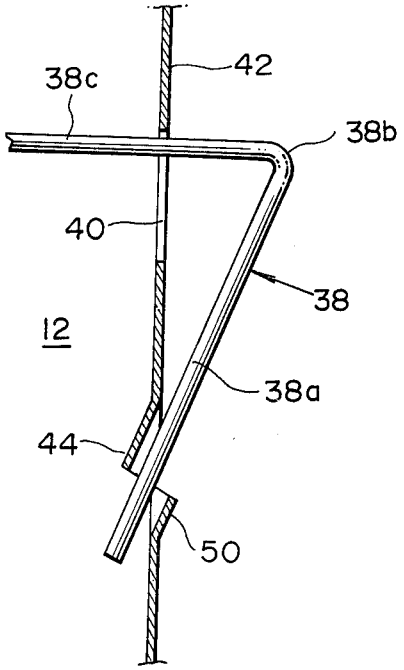
FIG. 3 is a sectional view taken along the line "III—III" shown in FIG. 2.
Figure 4:
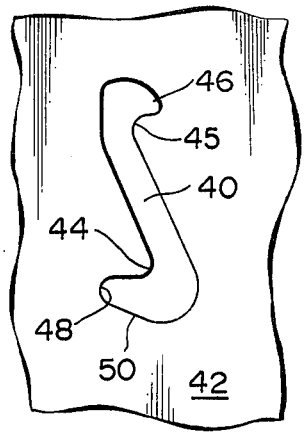
FIG. 4 is a front view of an S-shaped mounting hole shown in FIG. 2.

As is best shown in FIG. 4, the S-shaped mounting hole 40 is formed to have upper and lower tongue sections 45 and 44 which project in opposite directions, leaving two recesses 46 and 48 adjacent thereto, as shown. Denoted by numeral 50 is the bottom section of the mounting hole 40. As will be understood from FIG. 3, the lower tongue portion 44 is slightly bent toward the inside of the trunk 12, while the bottom section 50 is slightly bent outwardly so that a suitable gap is defined therebetween. In other words, the inner panel 42 has two portions 44 and 50 which partially define the perimeter of the hole 40. The two portions 44 and 50 are bent so that they project in generally opposite directions out of the plane of the major portion of inner panel 42 (as shown in FIG. 3). It should be noted that the dimensions of the mounting hole 40 are chosen so that the tip of bent end 38*a* is disposed a greater distance from major section 38*c* than the greatest distance across mounting hole 40. Further, the inner panel 42 adjacent the recess 48 is constructed to have a helically curved surface.

The engagement of the V-shaped end 38 of the torsion bar 30 with the mounting hole 40 is made as follows.

First, the angled corner section 38*b* of the V-shaped end 38 is inserted into the hole 40 with the tip of the bent end 38*a* remaining in the trunk 12. Then, the torsion bar 30 is rotated about the axis of the major section 38*c* thereof in a suitable direction until the major section 38*c* and the bent end 38*a* of the bar 30 are brought into contact with the recesses 46 and 48 of the hole 40, respectively. Under this condition, tight engagement between the V-shaped end 38 and the inner panel 42 of the rear pillar 32 is achieved because of the provision of the helically curved surface given to the lower tongue section 44 and the bottom section 50. The engagement of the other torsion bar 28 with the other S-shaped mounting hole formed in the pillar 34 is made in substantially the same manner as mentioned above.

It should be noted that the arrangement of the torsion bars 28 and 30 with respect to the corresponding arm members and the S-shaped mounting holes is so made that upon closing the lid 14 and locking the same in the closed position relative to the trunk 12, the torsion bars 28 and 30 are twisted about their axes to produce a torsional force to urge the lid 14 to open. Thus, upon releasing the lock, the lid 14 is caused to swing about the pivot pins 20 to open due to the combined torsional force of the torsion bars 28 and 30.

From the foregoing description, it will be appreciated that according to the present invention, a simple construction of the opening mechanism is achieved because of using the simple but assured mounting measure applied to the connection between the torsion bars and the rear pillars. This invention eliminates the need for the torsion bar mounting plate used in prior art devices. With the torsion bar mounting plate omitted, the trunk contains more usable space. Additionally, the S-shaped mounting holes can be easily formed in the vehicle pillar sections when stamped from sheet metal. Further, those skilled in the art will appreciate the ease with which the torsion bar is fitted into the S-shaped mounting holes.

What is claimed is:

1. An opening mechanism for use with a vehicle trunk having a pivotally opening trunk lid, comprising:

(a) a relatively thin inner panel in the vehicle trunk having an S-shaped torsion bar mounting hole formed entirely therethrough;

(b) a torsion bar having a bent first end portion inserted into said mounting hole wherein a bar portion adjacent one side of the bar bend is constrained against rotation by abutment against a first recess end of said mounting hole and a bar portion adjacent the other side of said bar bend is also constrained against rotation by abutment against a second recess end of said mounting hole, said torsion bar extending substantially parallel to the trunk lid and having a second end portion; and (c) mounting means associated with the trunk lid for engaging said torsion bar second end portion and constraining said second end portion against rotation relative to said mounting means, said torsion bar being twisted about its axis when the trunk lid is closed causing said torsion bar to generate a torsional force urging the trunk lid to open.

2. The mechanism of claim 1 wherein said inner panel has first and second portions partially defining the perimeter of said mounting hole, said first and second portions being bent to project in generally opposite directions, said first panel portion being bent to project towards the trunk interior, said second panel portion being bent to project away from the trunk interior, and said torsion bar bent first end has a V-shape, the vertex of said V-shaped first end extending through and beyond said mounting hole in the direction which is away from the trunk interior, and the tip of said V-shaped first end extending back through and beyond said mounting hole in the direction which is towards the trunk interior.

3. The mechanism of claim 2 wherein said inserted V-shaped first end portion is retained in said mounting hole by said first and second panel portions.

4. The mechanism of claim 3 further having a hinge for pivoting the lid to the trunk, said mounting means including an arm member fixed to the lid-affixed portion of said hinge, said arm member engaging said torsion bar second end portion.

5. The mechanism of claim 4 wherein said arm member has a longitudinally extending slot formed therein for receiving the tip of said torsion bar second end portion.

6. The mechanism of claim 5 wherein said torsion bar second end portion is C-shaped.

* * * * *